United States Patent [19]

Julstrom

[11] Patent Number: 4,696,036

[45] Date of Patent: Sep. 22, 1987

[54] DIRECTIONAL ENHANCEMENT CIRCUIT

[75] Inventor: Stephen D. Julstrom, Chicago, Ill.

[73] Assignee: Shure Brothers, Inc., Evanston, Ill.

[21] Appl. No.: 775,437

[22] Filed: Sep. 12, 1985

[51] Int. Cl.[4] ..... H04R 5/00

[52] U.S. Cl. ..... 381/22

[58] Field of Search ..... 381/17, 18, 1, 20, 21, 381/22, 19, 23

[56] References Cited

U.S. PATENT DOCUMENTS

| | | | |
|---|---|---|---|
| 3,835,255 | 9/1974 | Bauer | 381/21 |
| 4,574,391 | 3/1986 | Morishima | 381/18 |
| 4,589,129 | 5/1986 | Blackmer et al. | 381/21 |

*Primary Examiner*—Forester W. Isen

*Attorney, Agent, or Firm*—Alegretti, Newitt, Witcoff & McAndrews, Ltd.

[57] ABSTRACT

A system for receiving a plurality of audio input signals encoded with sound directions drives a plurality of loudspeakers which are physically arranged to generate apparent sound images in relation to encoded sound directions. The encoded input signals are analyzed for determining whether one encoded sound direction exceeds a predominance threshold with respect to other encoded sound directions. Logic control signals are generated for indicating directionality of predominant sound directions. In response to generated logic signals, the directional stability of the apparent sound images is enhanced.

20 Claims, 13 Drawing Figures

101
L' = L_T
R' = R_T
C' ≐ .707 L_T + .707 R_T
S' ≐ .707 L_T - .707 R_T
LS' ≐ .924 L_T - .383 R_T
RS' ≐ .924 R_T - .383 L_T
11
L_T
13
R_T
103
105
107
L'
C'
R'
S'
111
LS'
113
RS'
115
117
|L'|
119
|R'|
121
|C'|
123
|S'|
125
|LS'|
127
|RS'|
129
.303|L'|-|R'| > ε
.303|R'|-|L'| > ε
.303|C'|-|S'| > ε
.5|S'| - |C'| > ε
.164(|L'|+|C'|)-|RS'| > e
.164(|R'|+|C'|)-|LS'| > e
131
L̄
147
L̇UR̈
143
R̄
133
135
C̄
149
ĊUS̈
145
S̄
137
L̇C
139
ṘC
141

DIRECTIONAL ENHANCEMENT CIRCUIT

BACKGROUND OF THE INVENTION

The invention relates to multi-channel, multi-loudspeaker surround sound systems, and more particularly to systems having more loudspeakers than independent channels of signal information. More particularly, the invention concerns improving the directional accuracy of reproduced sound images over a wide listening area with minimal unnatural side effects.

A conventional two channel, two speaker stereo system can create sound source images (musical instrument, voice, etc.) along a line between the speakers for listeners located nearly equidistant to the speakers, with only limited psychoacoustic effects outside that line. To create directional effects around the listener or to enlarge the optimum listening area, more speakers are needed. For example, four speakers may be equally spaced around the listening area. Another example is the Dolby Stereo system for motion picture theatres, in which a line of three speakers is placed behind the screen and an array of speakers is disposed to the sides and rear of the audience; each of the speakers receive common signals.

While it would, of course, be desirable to have independent control over each of these typically four speaker signals, more often, particularly for the home consumer, only the two conventional stereo channels are available as independent signals. The large screen (70 mm) Dolby Stereo format does have four independent channels, but the smaller screen (35 mm) format has only two. It is this latter format's soundtrack which serves as the source for present stereo home video movie formats (videocassettes, videodiscs, stereo broadcast television).

In the two channel video soundtrack as well as other two channel surround sound formats, the directional information is encoded using the parameters of relative channel amplitude and/or phase according to the general principle disclosed in Scheiber, U.S. Pat. No. 3,632,886. This encoding may be a matrixing of four source channels into two, or a more general formula of continuous directional specification. In either case four decoded speaker signals cannot be recovered with complete signal independence. Most typically, sound coming predominantly from one speaker will also appear at only a 3 dB lower level in two others, typically adjacent speakers. For listeners near the center of a regular speaker array, this is not necessarily a serious problem, but for listeners outside the central region, or for other speaker arrays, it can lead to a significant loss of directional stability with varying listening locations. The apparent sound source will move strongly towards the closest and apparently loudest speaker and may also become more vaguely located.

For example, in the Dolby Stereo speaker arrangement, center speaker dialogue would appear at a 3 dB lower level in left and right. An off-center listener would hear the dialogue pulled away from center toward his direction, albeit to a lesser extent than would be the case in conventional two speaker stereo. A left speaker's sound effect would appear at a 3 dB lower level in the center speaker and the side-rear array leading to obvious localization difficulties, particularly for listeners near one of the side-rear speakers. A side-rear directional effect would appear at a 3 dB lower level in the left and right speakers, significantly reducing its directional accuracy, particularly for listeners near the front. Similar problems would exist for an image "panned" to left-center, for example, wherein the image appears equally in the left and center speakers and at a 7.7 dB lower level in the right and rear speakers.

Numerous means have been proposed to minimize this sort of problem and to make the four speakers sound more "discrete", concentrating for the most part on images located at the speakers. Of necessity all make some measurement of the predominant direction of sound at each moment and vary the speaker signals responsively to reduce the effect of unwanted leakage signals.

In Scheiber's U.S. Pat. Nos. 3,632,886 and 3,959,590 and in Bauer's U.S. Pat. Nos. 3,798,373; 3,794,781; 3,812,295 and 3,821,471, the gains (levels) of speakers momentarily deemed to be receiving leakage of the predominant signal are reduced in favor of the predominant speaker. Since level modulations of the individual speakers are bothersome, particularly to listeners away from the center of the array, most later devices involved the audibly less drastic measure of effectively varying the decoding matrix parameters to improve the isolation of a momentarily predominant sound at the expense of increased interspeaker leakage of sounds in other directions.

In Ito, U.S. Pat. Nos. 3,825,684 and 3,836,715 and Tsurushima, U.S. Pat. No. 3,786,193, variable mixing of the appropriate phase is introduced between speakers considered to have the predominant signal's leakage, resulting in leakage cancellation and loss of separation for other signals between those speakers.

In Hiramatsu, U.S. Pat. No. 3,829,615, a similar result is obtained by mixing the predominant sound's speaker signal into the two speaker signals with predominant sound leakage to effect cancellation. Again a loss of separation between the leakage speakers results.

In Gravereaux, et al., U.S. Pat. No. 3,943,287, a similar technique is employed with additional gain control amplifiers to maintain constant total power for the predominant signal as its leakage components are cancelled.

In Willcocks, U.S. Pat. No. 3,944,735, the decoding matrix modification is done with sufficient additional complexity to slightly modify and equalize the power levels in the three nonpredominant speakers, if desired. Approximate sensing is done of all directions around a theoretical 360° listening circle and approximate "directional enhancement" (leakage cancellation) matrix modification is performed for all such directions.

In Olson, U.S. Pat. No. 4,018,992, variable gain amplifiers are used to vary two leakage cancellation parameters per speaker to achieve a similar goal. In this case, the goal is perfect leakage cancellation for all encoded directions, specifically in combined amplitude-phase matrices such as SQ (Bauer, U.S. Pat. No. 3,835,255).

While a progession of capability is evident from this prior art review, all approaches are still bound by the fundamental limitation of two signal channels: only one, or at most two orthogonally encoded directions (meaning statistically independent, not at 90° locations in the listening room) can be reproduced simultaneously with complete leakage signal cancellation. (This is ignoring bandsplitting techniques as suggested by Ito U.S. Pat. No. 3,836,715.) This means that as the encoded soundfield progresses past the very simple, leakage cancellation cannot occur for all the multitude of sound source directions present. As individual sounds become less predominant, attempts at leakage reduction should also reduce, as justice cannot be done to the multiplicity of sound directions. This is explicitly or implicitly done on a proportional basis in all the above cited approaches, as the leakage cancellation is applied at a level which depends on the measured degree of directional predominance of (the leakage's) principal component (Gravereaux, et al. U.S. Pat. No. 3,943,287). Even with complex soundfields where many sounds are only briefly, mildly predominant, some varying leakage cancellation action remains. As explained by Bauer, et al., in relation to their circuit approach (Quadraphonic Matrix Perspective" JAES (Journal of the AES), vol. 21, June 1973). "As various signals become present simultaneously, the logic becomes progressively less active under all conditions. Nevertheless, there is instantaneous dominance of individual signals, allowing an adequate logic action to remain even with a "busy" quadraphonic program, since in this latter case human hearing is unable without much effort to follow the action of individual program sources". While judicious choice of response time constants can minimize the adverse audible effect of the resultant soundfield wandering, the net result of attempting to respond to the numerous simultaneous sound directions must be an unstable, jittery soundfield, simply describable as "fidgety".

This was recognized in the design of the Dolby theater decoder (Model CP-50, Cat. No. 150), which uses integrated circuits based on Willcocks, U.S. Pat. No. 3,944,735, with extensive add-ons to modify the operating characteristics. Only sounds which are strongly predominant in the direction of one of the speakers elicit rapid application of leakage cancellation signals. With complex sounds such as orchestral music lacking strongly predominant sound directions, response time is much slower, giving a longer averaging time and greatly reducing "fidgetiness". However, since most stereo music has more energy towards the center than other directions, this averaging will often result in a partial center "directional enhancement" and an undesirable narrowing of the soundstage. Also, nonspeaker-oriented directions such as left-center (partial dominance of left and center signals) are not responded to as rapidly and have their leakage signals cancelled only approximately.

Given the limitations inherent in any leakage cancellation technique, none of the prior art adequately addresses the goal of accurately cancelling the leakage from individual sounds from any encoded direction while not responding in an undesirable manner to less strongly directional soundfields. A system which does achieve this goal, combined with appropriate sensing and control time constants and characteristics, will give the optimum directional acuity to significant directional effects while minimizing aberrant soundfield wandering for more directionally complex soundfields.

It is therefore an object of the present invention to accurately cancel leakage signals in matrix decoded signals derived from encoded directional information for all encoded sound directions taken individually.

It is another object of the present invention to simultaneously cancel such leakage signals for two orthogonally encoded directional sounds occurring nearly simultaneously.

It is another object of the present invention to sense all encoded sound directions with approximately equal or otherwise preset sensitivity relative to other simultaneously occurring sounds.

It is another object of the present invention to achieve the other objects of the invention while not responding to complex sounds which do not have strongly predominant directions nor responding to non-directional sounds.

It is another object of the invention to provide for reduced or eliminated leakage cancellation for one or more directions on a frequency uniform or frequency selective basis to allow for a missing speaker or a speaker of limited frequency range, or to minimize audible side effects.

It is another object of the invention to maintain appropriate total power relationships for all the sound directions for any possible leakage cancellation condition.

It is another object of the invention to achieve the other objects of the invention using circuitry requiring a minimum of adjustment or precision components.

It is still another object of the invention to provide direction indicating logic signals suitable for center balance indication, control of automatic channel balancing, or other uses.

SUMMARY OF THE INVENTION

These and other objects of the invention are achieved in a preferred embodiment of the invention optimized for four speaker channel decoding of two information channel encoded Dolby Stereo surround sound, although modifications to suit other encoding parameters will be apparent to those skilled in the art, particularly in relation to systems intended for more symmetrical 360° presentation.

First, the two input signals (Lt and Rt) are decoded into four signals in a conventional sum and difference matrix. In the absence of directional sensing these four outputs (the original two (now L' and R') plus the sum attenuated 3 dB (C') and the difference attenuated 3 dB (S' for Surround)) are left unmodified, giving the inter-speaker leakage previously described. When a strongly predominant directional sound occurs, control signals are applied to one or two of four variable gain amplifiers which cross-couple the four outputs to effectively modify the decoding matrix. The control signals are applied in a step-wise approximation to the ideal coefficients which would perfectly cancel unwanted leakage signals. Worst case leakage-after-cancellation capability is approximately 20 dB below the level of the intended direction. Nearly constant total power is maintained for front signals: essentially exactly for signals pair-wise mixed at the encoder between L and C and between R and C, and within 2.5 dB for signals pair-wise mixed between L and R.

Sensing of the presence and directions of strongly predominant sound directions is achieved in nine segments across the front and a tenth in the surround (side-rear speaker) direction. Panned (pair-wise mixed) positions between front directions and S are intended through the use of phase shifts in the Dolby Stereo encoder, to appear in all speakers and are, therefore, not specifically sensed in the manner of the strongly directional signals. The sensing is done in six primary directions: L, LC, C, RC, R, and S. Sensing of four secondary directions are derived from the overlaps of the front primary direction regions.

Logic signals indicating a strongly predominant signal at or near a primary direction are developed at the outputs of six comparators. Each front logic signal is activated when the detected level in its primary direction exceeds the detected level in the orthogonally encoded direction by 10.4 dB. This gives both equally spaced sensing segments in conjunction with the overlaps and, in conjunction with the characteristics (frequency response, time constant) of the level detecting circuits, a good differentiation between strongly predominant sound directions and less strongly predominant ones. The level of a less strongly predominant sound does not sufficiently exceed the orthogonally directed level detection, which contains input from all directions other than the potentially sensed one. Instead of giving an output proportional to the degree of directional predominance of a sound, the comparators give an indication only when a directional sound is strongly predominant, thus avoiding undesirable activity for complex soundfields.

The sensitivity of the direction sensing in the presence of a complex soundfield (a sound field containing many simultaneous sound directions) is substantially uniform for all front directions. S sensing is made somewhat more sensitive (6 dB criterion vs. 10.4 dB for front directions). This does not result in unwanted sensing since in a complex soundfield, the difference signal (S) is generally weaker than signals in other directions.

The six level detectors are wide dynamic range, precision full-wave rectifiers with integral 20 msec averaging and frequency response shaping to emphasize mid-frequencies, which contain the most significant directional information. They sense the level of L', C', R', S', and directions orthogonal to LC' and RC'. The levels of LC' and RC' are derived with sufficient accuracy from L', C' and R', C', respectively.

The six directional logic signals developed control a resistor matrix to determine, through buffer amplifiers, the control signals for the variable gain amplifiers (VGA's). Each VGA receives a close five step approximation (two steps for the S leakage cancelling VGA) to its ideal control signal through a dual 7 msec time constant second order smoothing filter. By controlling the derivative of the rate of change of the leakage cancellation, the fastest rate of change can be allowed while still minimizing audible "jerkiness".

The signals at the resistor matrix are also a function of memory capacitors which prolong the effect of direction sensing. Their charging rate is limited to give less permanency to the response to short duration directional effects. When sensing a new direction soon after a previous one, the effect of the memory of the previous direction is reduced to a degree and at a rate dependent on the orthogonality of the two directions and thus on the compatability of their leakage cancellation parameters. Two orthogonal directions may be nearly simultaneously sensed and responsively simultaneously enhanced without mutual interference in their leakage cancellation.

Leakage cancellation of C into L and R is purposely limited to no better than about 15 dB. This is adequate to give excellent center directionality over a wide listening area and minimizes audible side effects from the leakage cancellation action for far off-center listeners. Additionally, the leakage cancellation is made to decrease at lower frequencies, finally becoming ineffective below 80 Hz. The low frequencies are less audibly directional in rooms and so do not benefit so much from leakage cancellation. Removing bass leakage cancellation for center signals (where bass is usually "mixed" in production) maintains a distribution of the bass energy among the three front speakers. This is particularly helpful if the center speaker is small and lacking in bass response. Provision is also made for easy defeat of all leakage cancellation for center signals, in the event that no center speaker is used. The benefits of L-S and R-S leakage cancellation would remain.

The direction sensing logic signals may also be used for additional purposes, such as providing visual indications of the directions of strongly predominant sound sources. A center balance indicator lit by a sound in the narrowest center segment indicates good Lt-Rt balance from the program source if that sound is, for example, center dialogue. Automatic center balance can be effected by forcing a long-term average equality in the levels of Lt and Rt. This convergence can be made quicker without causing incorrect balancing if the rate of convergence increases significantly as a function of the sensing of strongly predominant sounds close to what appears to be center. The result is to converge more rapidly the closer the Lt-Rt balance becomes, while not being confused by strongly L or R biased sounds.

DESCRIPTION OF THE PREFERRED EMBODIMENT

Figure 1:
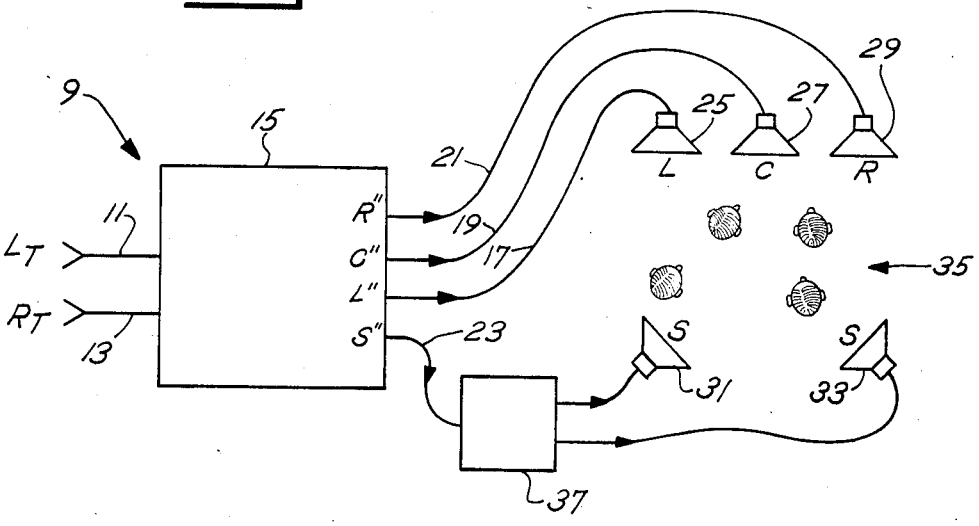
FIG. 1 is a block diagram of a preferred embodiment of a surround sound system of the present invention.

Referring to FIG. 1, a surround sound system 9 accepts at inputs 11, 13 two signals Lt and Rt, respectively carrying directionally encoded information in two channels. The signals Lt, Rt may originate from any two channel audio source such as records, compact discs, audio cassettes, or FM broadcast, and may be associated with simultaneous video, such as videodiscs, videocassette recorders, stereo broadcast television, or 35 mm film. A processor 15 decodes the information carried by the input signals and generates four output signals L", C", R", and S" at respective outputs 17, 19, 21, and 23. A listening area 35 includes three loudspeakers 25, 27, and 29 situated at left front, center front, and right front, respectively, and two loudspeakers 31 and 33 situated at left rear and right rear, respectively. Speakers 31, 33 are called "surrounds" and are designated with the letter S in FIG. 1. Each loudspeaker symbol in FIG. 1 includes appropriate power amplification.

Outputs 17, 19, and 21 feed speakers 25, 27, and 29, respectively, and output 23 feeds speakers 31 and 33 via a processor 37. Processor 37 is a conventional signal processor, typically providing frequency response shaping, a time delay, and possibly processing to make the sound from speakers 31, 33 more diffuse-sounding.

The preferred embodiment is optimized for playback of Dolby Stereo encoded surround sound information. Processor 15 includes a basic decoding matrix of a simple sum and difference network for generating four decoded signals (before leakage cancellation) as follows:

$$L' = Lt$$

$$R' = Rt$$

$$C' = 0.707Lt + 0.707Rt$$

$$S' = 0.707Lt - 0.707Rt$$

These signals are then utilized to create the output signals L'', C'', R'' and S''.

Figure 2:
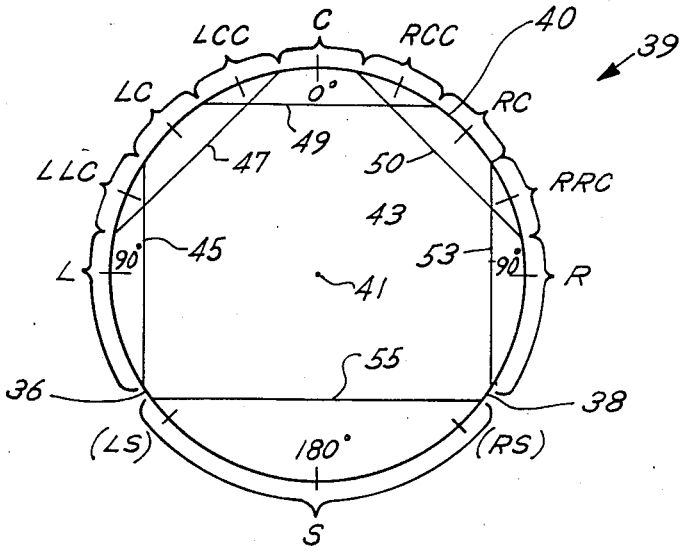
FIG. 2 is a diagrammatic representation used to describe the sound field encoded in Lt and Rt signals and to describe subsequent decoding and direction sensing of the system of FIG. 1.

Understanding the matrix and the action of processor 15 is aided by a diagrammatic representation 39 shown in FIG. 2. Representation 39 is used to describe the soundfield encoded in Lt and Rt signals. Only the relative amplitudes and phases of Lt vs. Rt are represented, not their absolute values. Each point on the perimeter of a circle 40 represents a specific amplitude ratio of Lt to Rt in either an in-phase or reverse polarity (180° out-of-phase) relationship. Specifically, the angular position $\theta$ clockwise from the top of circle 40 is given by:

$$\theta = \left(2 \tan^{-1} \frac{Lt}{Rt}\right) - 90°$$

Equal Lt and Rt signals is represented by point C on circle 40 ($\theta = 0°$). Lt signal only is represented by point L ($\theta = 90°$), and Rt signal only is represented by point R ($\theta = -90°$). Equal but opposite polarity Lt and Rt is represented by point S ($\theta = 180°$). Lt=2.414 Rt is represented by LC ($\theta = 45°$), and so on.

Each of the decoding equations given above yields a maximum response (maximum gain) in just one encoded direction, hereinafter called the decoding direction. Other decoding equations such as described hereinafter also yield maximum response in just one encoded direction, also called decoding directions. There is also varying response for all other encoded directions except the orthogonally encoded direction, located in diagram 39 diametrically opposite through the center 41 from the maximum response direction. The magnitude of the response of a decoded output to any encoded perimeter direction is given by:

$$\cos \frac{\Delta\theta}{2}$$

where $\Delta\theta$ is the difference between the encoding and decoding directions. (Further explanation of this representation is given in "Analyzing Phase-Amplitude Matrices", Peter Scheiber, JAES, vol. 19, Nov. 1971 which is incorporated herein by reference.) Each encoded direction, then, appears not only in its desired decoded output or outputs but also in two others leading to the audible localization difficulties discussed in the Background section.

The interior of the circle is given meaning in relation to encoded signals which are not strictly in phase or out of phase between Lt and Rt. These can arise in two ways. Multiple simultaneous encoded sound directions will combine in Lt and Rt with random phase and amplitude relationships. Also, the Dolby Stereo encoder introduces a quadrature phase relationship between the front-encoded sound directions (L, C, R and directions panned between them) and the surround (S) encoding direction. This results in, for example, a sound pair-wise mixed halfway between C and S appearing equally in all four decoded outputs (L', C', R', S'). Such soundfields are assigned points in the interior of the circle based on the short term time averages of the magnitudes (hereinafter called levels and designated with | |) of the four decoded outputs L', C', R', S' (before leakage cancellation). The radius of the circle is considered to be unity. The radial distance up from the center 41 is given by:

$$x = \cos\left(2 \tan^{-1} \frac{|S'|}{|C'|}\right)$$

and the radial distance to the left from the center 41 is given by:

$$y = \cos\left(2 \tan^{-1} \frac{|L'|}{|R'|}\right)$$

To find the decoded output levels from x and y, the equations may be solved in reverse with the added fact that:

$$|C'|^2 + |S'|^2 = |L'|^2 + |R'|^2$$

Sounds pair-wise mixed (panned) between any front directions in the Dolby encoder (L and C, R and C, L and R) appear on the upper semicircle perimeter between 90° and −90°. Sound mixed at the surround input appears at the 180° point on the perimeter. Sounds panned between a front direction and the S direction appear on a chord connecting the two perimeter points. For example, sounds panned between L and S appear on a chord connecting the 90° perimeter point to the 180° perimeter point (not on the perimeter arc connecting the points). Thus the perimeter points between 90° and 180° and −90° and −180° do not represent encoded directions and need not be specifically sensed for leakage cancellation purposes. Complex soundfields are represented by a moving point which generally lies well within the interior of the circle, only being pushed near the perimeter by a strongly predominant sound direction. The degree of movement towards the perimeter is also dependent on the averaging time of the level sensing circuitry employed, moving more actively and thus more often closer to the perimeter the shorter the averaging time.

Soundfield representation points lying within the area bounded by the chords illustrated in diagram 39 and the perimeter arcs they subtend will elicit directional sensing and leakage cancellation action. Other points lying in the area 43 bounded by the six chords and the two small non-subtended perimeter arcs 36, 38 will not.

The chords 45, 47, 49, 51 and 53 all subtend equal arcs of 67.5° giving perimeter sensing arcs of ±33.75° about directions L, LC, C, RC, and R, respectively. For L, C, and R the sensing is achieved when |L'|, |C'|, and |R'| exceed |R'|, |S'|, and |L'|, respectively by $$\frac{1}{\tan\left(\frac{33.75°}{2}\right)} = \frac{1}{.303} = 10.4 \text{ dB}$$

plus a small offset $\epsilon$ to control circuit operation at very low signal levels. To sense LC and RC, the orthogonal directions RS' and LS' are generated by the equation:

$$RS' = 0.924Rt - 0.383Lt$$

$$LS' = 0.924Lt - 0.383Rt$$

As noted previously, these do not represent encoded directions in Dolby. Stereo but are indicated at $\theta = -135°$ and $+135°$, respectively in FIG. 2 as equivalent decoding directions. To avoid additional decoding and level sensing circuitry, LC and RC levels are derived from |L'|, |C'|, and |R'| by the following relationships:

$$|LC'|_{equivalent} = \frac{|L'| + |C'|}{2(.924)}$$

$$|RC'|_{equivalent} = \frac{|R'| + |C'|}{2(.924)}$$

$|LC'|_{equivalent}$ and $|RC'|_{equivalent}$ are then compared to |RS'| and |LS'|, respectively in the same manner as L, C, and R sensing.

The five primarily sensed front directions, L, LC, C, RC, and R overlap in four regions representing LLC, LCC, RCC, and RRC. These overlap regions determine intermediate leakage cancellation coefficients distinct from those determined from the primary direction sensing. The total of nine distinct front sensing arcs are all equally sized at ±11.25° centered on their primary direction except for L and R, which extend downward farther into an unused area without harm. The total sensing area adjacent to the upper semicircle perimeter from 90° to −90° (representing front sounds) is of substantially uniform radial width indicating a uniform sensitivity to all front directions in the presence of a simultaneous complex soundfield.

For S sensing, |S'| is required to be only 6 dB above |C'| giving chord 55, subtending an arc of $\pm 2\tan^{-1}(0.5) = \pm 53°$ about $\theta = 180°$. Although the resultant bounded sensing area reaches farther into the interior of the circle, this does not elicit false sensing for complex soundfields since it is in the difference information area, as discussed in the Summary.

Figure 3:
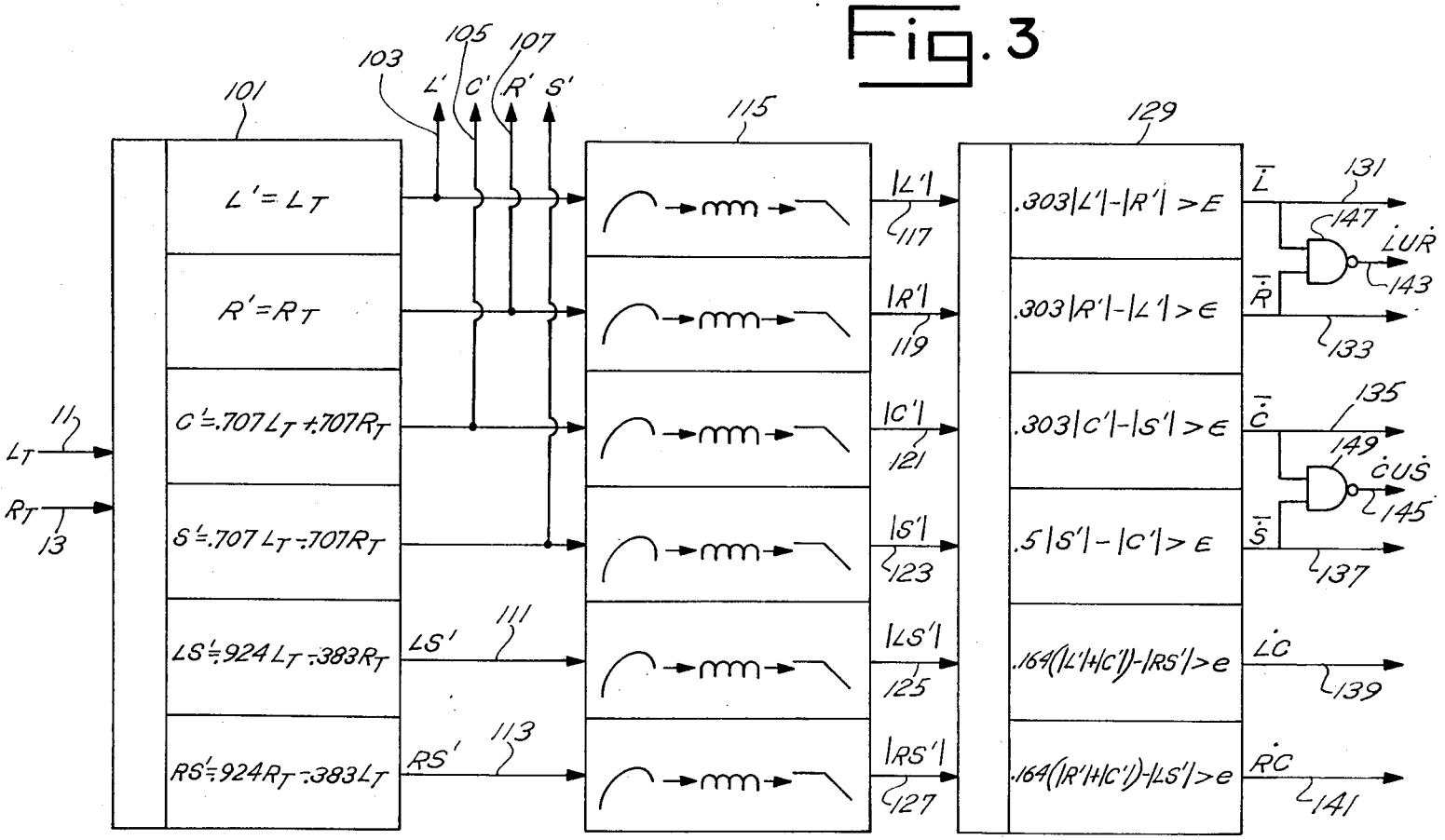
FIG. 3 is a block diagram of circuitry used to develop logic control signals for the system of FIG. 1.

FIG. 3 shows in block diagram form the circuitry used to develop the logic signals representing direction sensing, i.e., logic signals representing that there exists a strongly predominate sound direction and what that direction is. Block 101 represents the decoding matrix sum and difference amplifiers which develop L', C', R', S', LS', and RS' at outputs 103, 105, 107, 109, 111, and 113, respectively from input signals Lt and Rt at inputs 11 and 13, respectively according to the equations previously defined. The sum and difference amplifiers are of conventional design.

Block 115 represents six identical frequency response shaping, precision, wide dynamic range full-wave rectifiers with integral 20 msec low pass filters which develop |L'|, |R'|, |C'|, |S'|, |LS'|, and |RS'| at 117, 119, 121, 123, 125, and 127, respectively from L', R', C', S', LS', and RS' at 103, 107, 105, 109, 111, and 113, respectively. The frequency response shaping emphasizes mid-frequencies and approximates an audiometric A-weighting curve. The response shaping and 20 msec filter time constant in conjunction with the comparison ratios of the following block 129 result in an optimum differentiation between strongly predominant and less strongly predominant directional sounds.

Block 129 represents six level comparators using |L'|, |R'|, |C'|, |S'|, |LS'|, and |RS'| to develop logic signals $\bar{L}$, $\bar{R}$, $\bar{C}$, $\bar{S}$, $\overline{LC}$, and $\overline{RC}$ at outputs 131, 133, 135, 137, 139, and 141, respectively according to the relations described above. The inversions of $\dot{L}$, $\dot{R}$, $\dot{C}$, and $\dot{S}$ are developed for the convenience of the following circuitry. Also, signals $\dot{L}U\dot{R}$ and $\dot{C}U\dot{S}$ are developed at outputs 143 and 145, respectively, via NAND gates 147 and 149, from logic signals $\bar{L}$, $\bar{R}$, $\bar{C}$, and $\bar{S}$.

Figure 4:
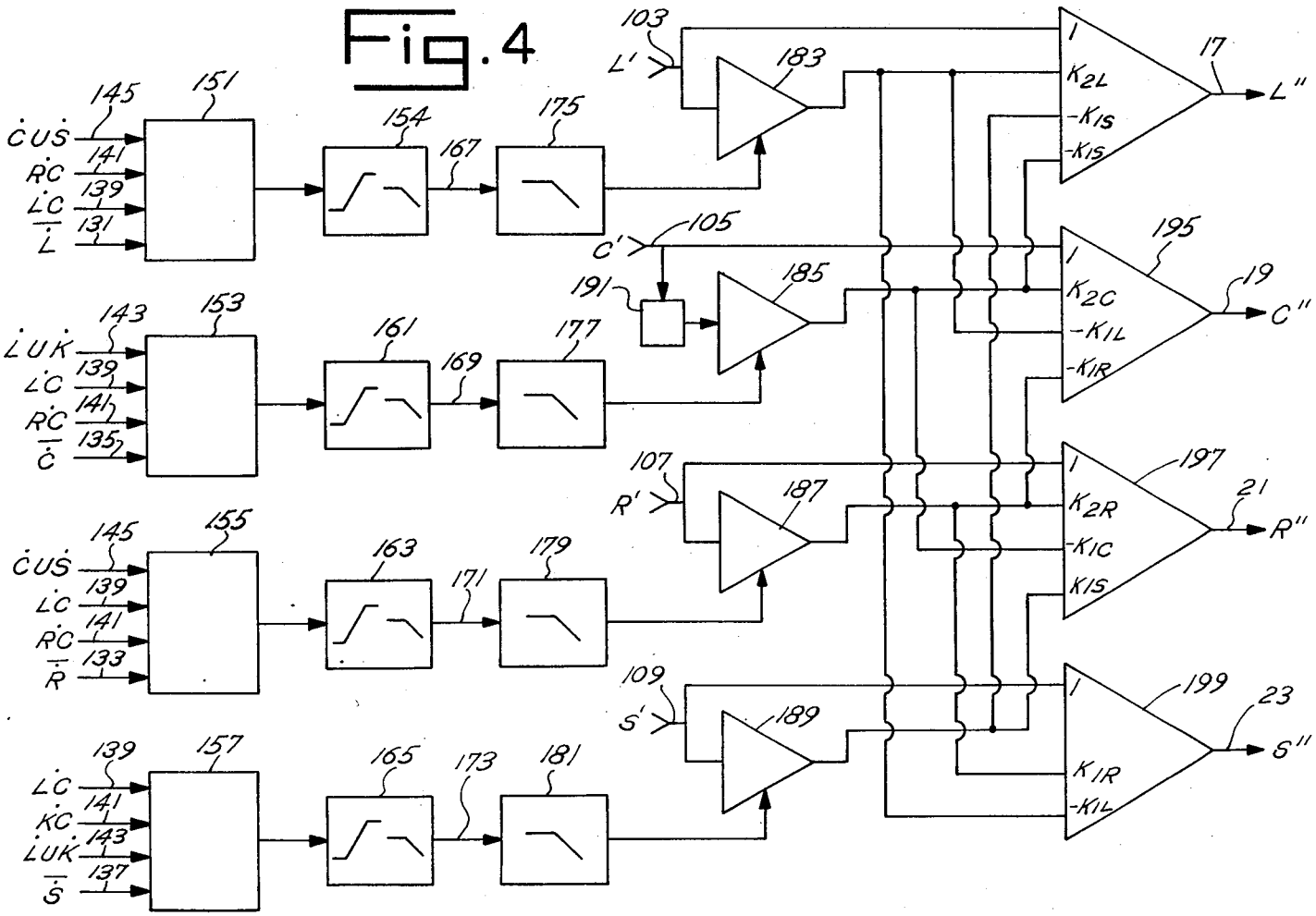
FIG. 4 is a block diagram of a leakage cancellation matrix and control coefficient generating circuitry of the system of FIG. 1.

FIG. 4 shows a block diagram of the leakage cancellation matrix and its control coefficient generating circuitry. The four blocks 151, 153, 155, and 157 use the logic signals on outputs 131–145 to develop step-wise approximations to the ideal voltages for controlling the leakage cancelling variable gain amplifiers 183, 185, 187, and 189, respectively. Blocks 151–157 also contain memory capacitors to prolong the effect of direction sensing as discussed previously and described hereinafter in connection with FIG. 10. Blocks 159, 161, 163, and 165 buffer and limit the voltages produced by blocks 151–157, respectively, and provide a 7 msec low pass filter to smooth rapidly changing voltage levels. The blocks 159–165 limit the voltages at full up and full down to provide stable, solid full off and full on conditions (corresponding to no leakage cancellation or the sensing of encoded sound directions very close to L, C, R, or S). The outputs of blocks 159–165 developed at outputs 167, 169, 171, and 173, respectively feed 7 msec low pass filters 175, 177, 179, and 181, respectively. These additional low pass filters limit the first derivative of the rate of change of the leakage cancellation parameters, reducing soundfield "jerkiness", as previously described.

The outputs of low pass filters 175–181 feed the gain control inputs of variable gain amplifiers (VGA) 183, 185, 187, and 189, respectively. Each VGA 183–189 has an audio signal input from outputs 103–109, respectively containing signals L', C', R', and S', respectively. VGA 185 receives C' from output 105 via a 80 Hz high pass filter 191. The output of VGA's 183–187 feed mixers 193, 195, and 197, respectively with gains of $K_{2L}$, $K_{2C}$, and $K_{2R}$, respectively to maintain appropriate power relationships when leakage signals are cancelled. Each VGA 183–189 also feeds each adjacent mixer with gain $K_{1L}$, $K_{1C}$, $K_{1R}$, and $K_{1S}$, respectively of the appropriate polarity to cancel unwanted adjacent speaker leakage. Each mixer 193–199 also receives an input at unity gain from L', C', R', and S', respectively from outputs 103–109, respectively. Mixers 193–199 develop outputs L'', C'', R'', and S'', respectively at outputs 17–23, respectively.

The values of $K_1$ and $K_2$ are shown graphically in FIG. 5 as a function $\Delta\theta$, the difference beteen the encoded direction and the decoding direction, L', C', or R' (S' is treated differently, as will be discussed hereinafter). The dashed line 201 gives the exact coefficients for perfect leakage cancellation and the chosen power correction. The equations for $\Delta\theta \leqq 90°$ are:

$$K_1 = \frac{1}{\tan \Delta\theta + \sqrt{2}}$$

$$K_2 = (2 - \sqrt{2})K_1$$

and for $\Delta\theta > 90°$ $$K_1 = K_2 = 0$$

The resultant power correction is exact for front sounds which are pair-wise mixed with standard sine-cosine relationships between L and C and between R and C if L, C, and R are then encoded as:

$$L_I = 0.707C + L$$

$$R_I = 0.707C + R$$

This would be the case when encoding from a discrete four-track master. This matches the case of sine-cosine panning between L and R only at L, C, and R. The former mixing technique exhibits a power buildup over the latter equal to:

$$1 + \frac{|\sin(2\theta)|}{\sqrt{2}}$$

which reaches a maximum of 2.3 dB at LC and RC. Thus for the latter panning technique, the power correction applied results in a 2.3 power drop at LC and RC positions relative to L, C, and R positions. Sounds at LC and RC also exhibit a 2.3 dB power drop relative to the total power with leakage before leakage cancellation is applied. Sounds at L, C, and R do not and are compensated exactly. In either case, the power levels remain substantially at the correct levels.

Figure 5:
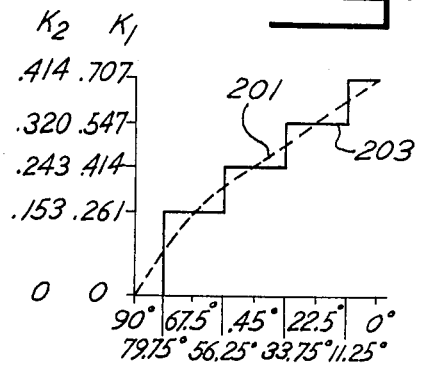
FIG. 5 is a graph of leakage cancellation coefficients and power cancellation coefficients utilized in the system of FIG. 1.
Figure 6:
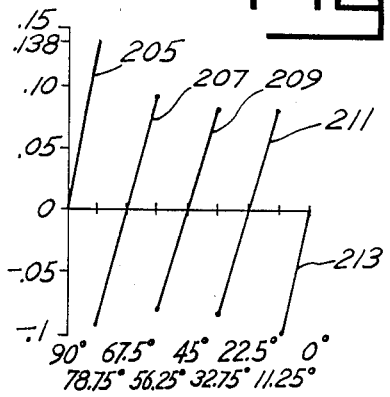
FIG. 6 is a graph of the remaining unwanted leakage signals of the system of FIG. 1.

Line 203 in FIG. 5 shows the actual step-wise approximations to $K_1$ and $K_2$ developed for each sensing arc segment. The coefficients are exact in the nominal center of each sensing segment. FIG. 6 shows the remaining leakage in the adjacent channel which is not pair-wise mixed, again as a function of $\Delta\theta$, as curves 205, 207, 209, 211, and 213. The leakage is given by $$\cos\theta\left(\frac{1}{\sqrt{2}} - K_1\right) - \sin\Delta\theta\left(\frac{K_1}{\sqrt{2}}\right)$$

The worst case leakage is just beyond $\theta = 78.75°$ and is down 17.2 dB. Since the intended direction has been raised in level 3 dB by the power correction, the leakage is actually about 20 dB below the desired signal. This low level of leakage or better is maintained for all encoded directions.

Figure 7:
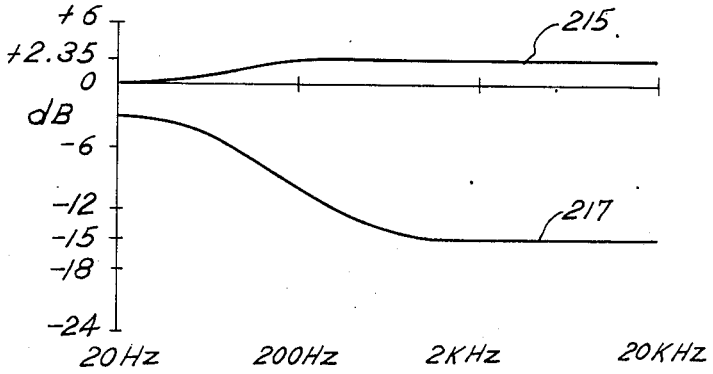
FIG. 7 is a graph showing the frequency responses for a C input signal of the system of FIG. 1.

The coefficients $K_{1C}$ and $K_{2C}$ associated with at least partially C oriented directions are slightly modified from those just shown. The values are scaled down slightly to limit the leakage cancellation to about 15 dB. Further, the cancellation and power correction signal is high pass filtered at 80 Hz for reasons previously discussed. The resultant frequency responses for a C input signal are shown in FIG. 7. Curve 215 is the response of C'' at output 19 of FIG. 4, and curve 217 is the response of L'' and R'' at output 17 and 21, respectively, of FIG. 4.

The S cancellation coefficient $K_{1S}$ does not follow curve 203 of FIG. 5. It is simply off (0) or full on (0.707) since there are no perimeter directions panned within 90° of S except $\theta = 180°$. Power correction coefficient $K_{2S}$ is not used (left at 0). This means that when S sensing is activated, the level of S'' is not boosted 3 dB. This is to avoid unnatural loudness jumps for listeners seated near the surround speakers and away from the front speakers.

Figure 8:
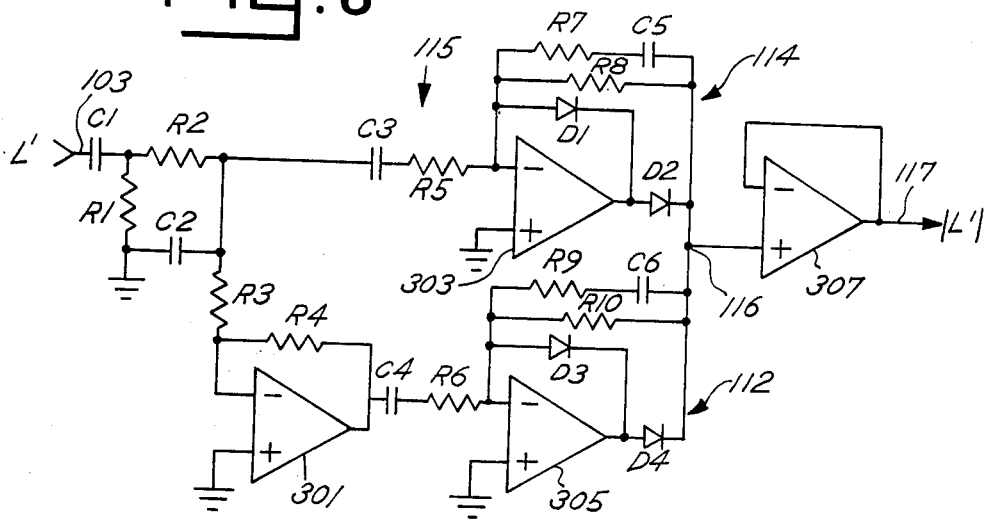
FIGS. 8 and 9 are schematic diagrams of the circuitry of FIG. 3.

FIG. 8 shows one of the six identical circuits in block 115, FIG. 3, which develops the level indicating signals. FIG. 8 shows the circuit which develops |L'| on output 117. Operational amplifiers 301, 303, 305, and 307 are conventional integrated circuit types, Raytheon RC4156 or equivalent. Diodes D1, D2, D3, and D4 are type 1N4148 or equivalent. Resistors R1, R2, R5, and R6 and capacitors C1, C2, C3, and C4 perform frequency response shaping. Resistors R3 and R4 with op amp 301 form an inverter. Resistors R7, R8, diodes D1, D2, capacitor C5 and op amp 303 form a precision half-wave rectifier 114 having a 20 msec filter. Similarly, resistors R9, R10, diodes D3, D4, capacitor C6, and op amp 305 form a precision half-wave recifier 112. Rectifiers 112, 114 are connected together at their outputs 116 to form a full wave rectifier with low output offset voltage. The output 116 is buffered by a unity gain buffer op amp 307. All op amps, transconductance amplifiers, and comparators in FIGS. 8–13 are connected to regulated ±15 volt supplies in a conventional manner.

Figure 9:
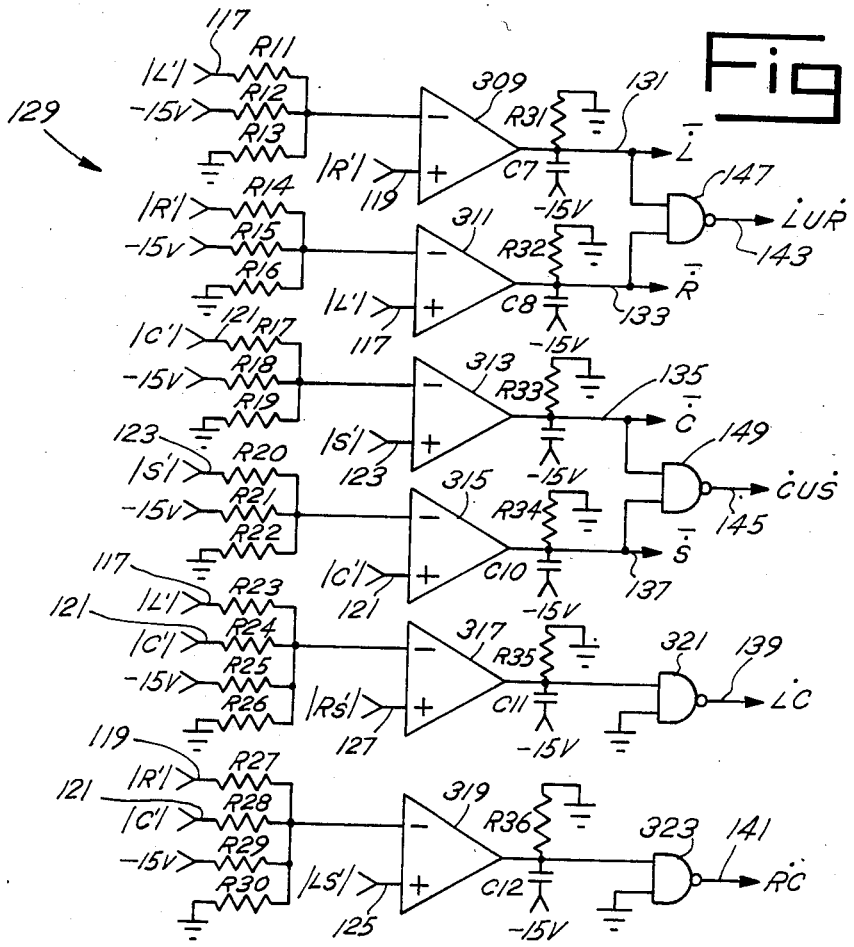

FIG. 9 shows the six comparator circuits of block 129, FIG. 3. Comparators 309, 311, 313, 315, 317, and 319 are preferably National Semiconductor LM339 or equivalent. The outputs of comparators 309–319 are open-collector, pulled up to ground by R31, R32, R33, R34, R35, and R36, respectively, so that a logic "true" at a comparator output is 0 volts and a logic "false" is about −15 volts. Capacitors C7, C8, C9, C10, C11, and C12 prevent oscillations at the comparator outputs during logic level transitions. For convenience of the circuitry which follows that of FIG. 9, the outputs of comparators 309–319 are inverted in that sensing of a direction causes them to go to −15 volts. The outputs of comparators 317 and 319 are inverted and buffered by NAND gates 321 and 323, respectively to form $\dot{L}C$ and $\dot{R}C$ respectively at outputs 139 and 141, respectively. $\dot{L}U\dot{R}$ and CUS signals are formed as described in connection with FIG. 3. Resistors R11–R30 scale and slightly offset the comparator inputs according to the formulas in block 129 of FIG. 3. The four NAND gates are a quad CMOS IC Type CD4011B or equivalent powered between −15 volts and ground.

Figure 10:
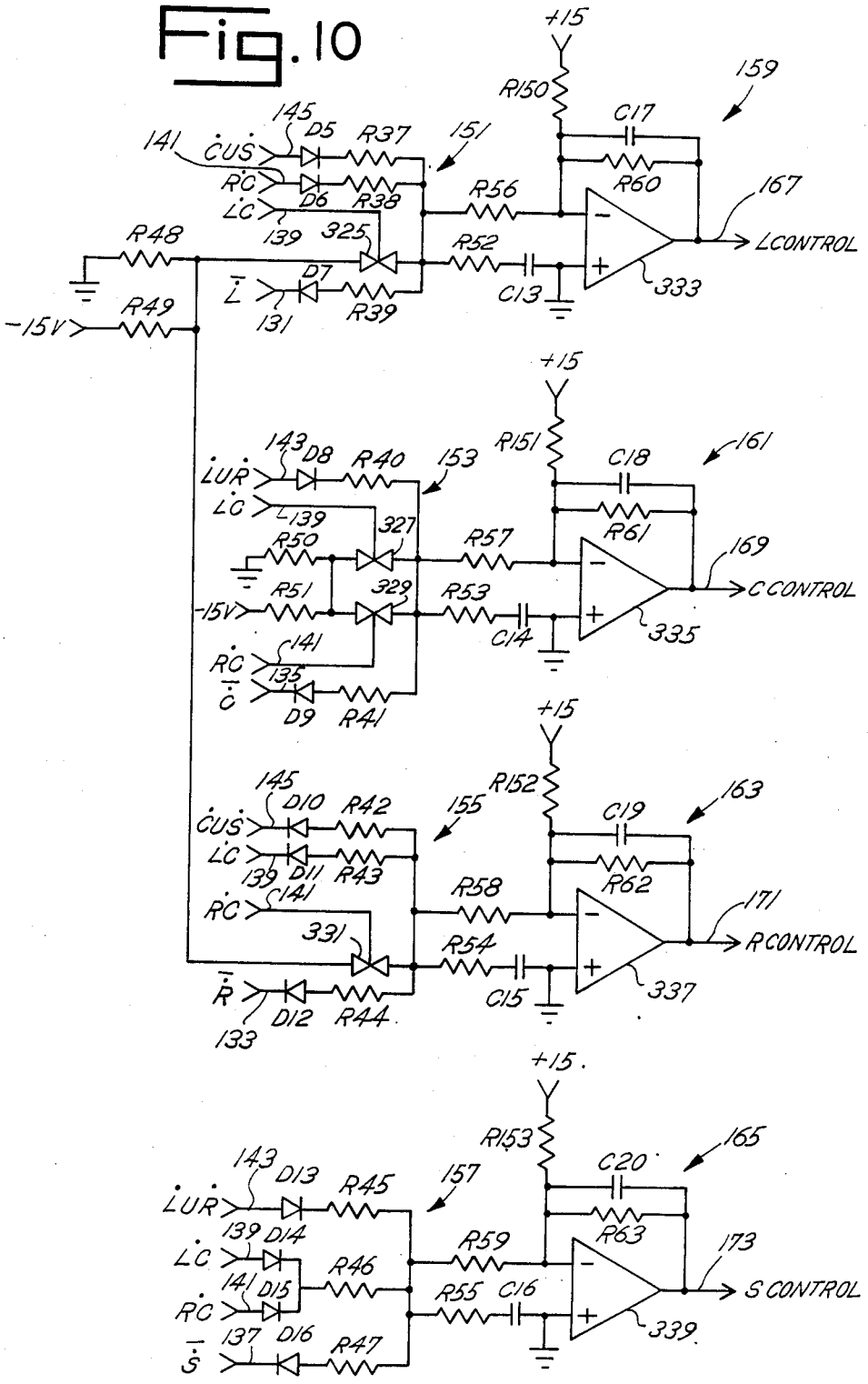
FIGS. 10 and 11 are schematic diagrams of the circuitry of FIG. 4.

FIG. 10 shows the portion of the circuitry shown in FIG. 4 in block diagram form which generates the variable gain amplifier control signals. Switches 325, 327, 329, and 331 are a quad CMOS analog switch type CD4066B or equivalent powered between −15 volts and ground. Op amps 333, 335, 337, and 339 are RC4156 or equivalent. Diodes D5–D16 are type 1N4148 or equivalent. Resistors R37–R51, diodes D5–D16, and switches 325–331 form five step Thevenin-equivalent voltage sources between 0 and −15 volts through varying equivalent source impedances under the control of the logic signals on outputs 131–145. The resultant voltage levels are applied to R56, R57, R58, and R59 for input to inverting buffer-limiter circuits 159–165. The control signals appearing at outputs 167–173 are scaled, offset, and limited to vary from about −13.5 volts with no leakage cancellation to a maximum of about +13.5 volts. Capacitors C17, C18, C19, and C20 slow the voltage transitions with a 7 msec time constant.

Capacitors C13, C14, C15, and C16 have discharge time constants into resistors R56–R59, respectively of about 1 to 2 seconds and so, once charged, prolong a specific leakage cancellation characteristic in the absence of subsequent direction sensing. The maximum rate of charge and discharge of capacitors C13–C16 is limited to about a time constant of 50 msec to 100 msec by resistors R52, R53, R54, and R55, respectively, which also buffer the capacitor voltages from the other circuitry so that short transient sounds can be "caught" and have appropriate leakage cancellation performed while still being able to return immediately to the previous, longer-lasting leakage cancellation condition. With the component values and circuit topology shown, sensing C, for example, immediately after sensing L will quickly bring C control to a maximum of 13.5 volts and L control to a minimum of −13.5 volts while charging C14 and discharging C13 at their maximum rates. Sensing R immediately after sensing L, however, leaves L control unchanged at +13.5 volts while simultaneously bringing R control high to +13.5 volts. C13 is left to decay at its slowest one second rate. Thus diametrically opposite positions are left to "coexist" since their leakage cancellation parameters are compatible, while directions 90° apart cannot have simultaneous leakage cancellation and so must compete. LC sensing immediately after L sensing represents an in between case, so L control is pulled down quickly only halfway, and then further decays with a 200 msec time constant.

Figure 11:
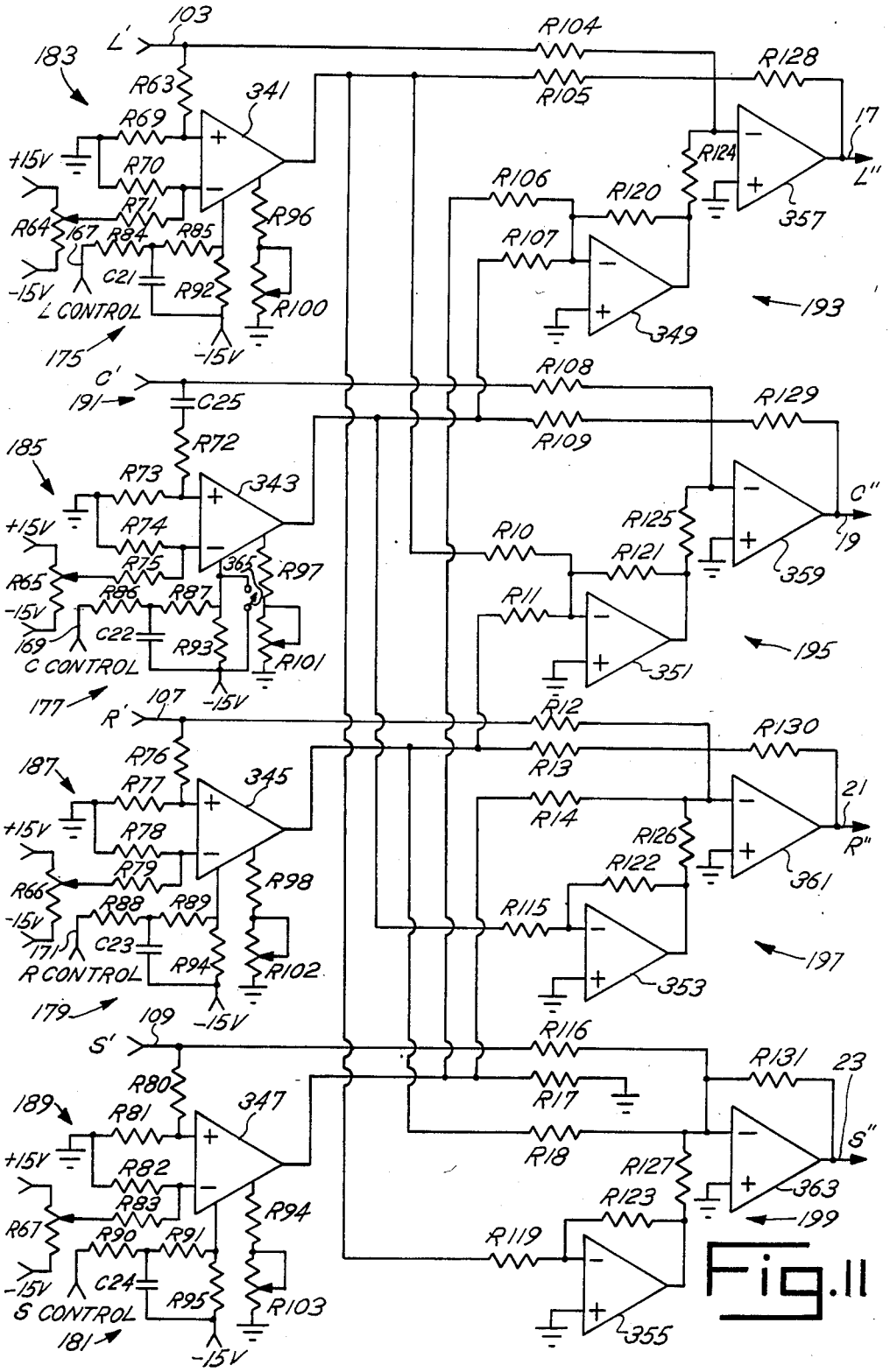

FIG. 11 shows the circuitry of blocks 175–199 of FIG. 4, specifically the second control voltage smoothing filters 175–181, the VGAs 183–189, high pass filter 191, and mixers 193–199. Current-controlled operational transconductance amplifiers (OTA) 341, 343, 345, and 347 are RCA type CA3280. Op amps 349–363 are RC4156 or equivalent. Resistors R64, R65, R66, and R67 trim the offsets of OTA's 341–347, respectively to minimize control signal feedthrough to the audio signal path. Resistors R68–R83 scale the audio inputs from conductors 103–109 for minimum distortion and maximum dynamic range. Resistors R100–R103 in conjunction with resistors R96–R99 set and trim the current in the input linearizing diodes of OTA's 341–347 to set and trim the gain of the OTA's for best leakage cancellation. The gain of OTA 343 is adjusted slightly lower to limit the leakage cancellation for center signals as discussed previously. Capacitor C25 high-passes the audio input to OTA 343 at 80 Hz for the reasons discussed previously.

Resistors R84–R91 scale the control voltages on conductors 167–173 to provide the appropriate gain control currents for the OTAs. Resistors R92–R95 make sure that the OTAs are off (0 gain) when the control signals on conductors 167–173 are at their minimum of −13.5 volts. Capacitors C21–C24 provide the second 7 msec time constant for the control signals. Switch 365 can be closed to eliminate leakage cancellation for center signals if no center speaker is used. Resistors R104–R131 and op amps 349–363 mix the outputs from OTA's 341–347 and L', C', R', and S' on conductors 103–109 in the proper proportions and polarities to fulfill the design equations. Specifically, resistors R105–R107, R109–R111, R113–R115, and R117–R119 divide the output currents from the OTA's in the proper $K_1$:$K_1$:$K_2$ ratios. R117 maintains this division even though its power equalizing current ($K_{2S}$) goes to ground rather than contributing to S".

Figure 12:
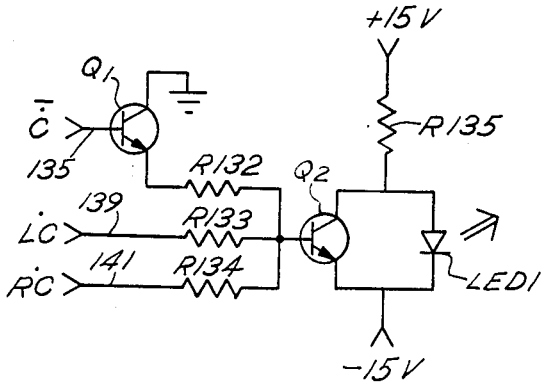
FIG. 12 is a schematic diagram of a center balance indicator using the logic signals developed by the circuitry of FIG. 3.

FIG. 12 shows the use of the direction sensing logic signals for center balance indication. Transistors $Q_1$ and $Q_2$ are general purpose NPN types 2N5210 or equivalent. LED1 is any LED suitable for 20 ma operation. The LED lights when the statement $\dot{C}$ ($\overline{LCURC}$) is true. This is true only when the sound direction is in the center 22.5° segment, indicating an accurately centered signal.

Figure 13:
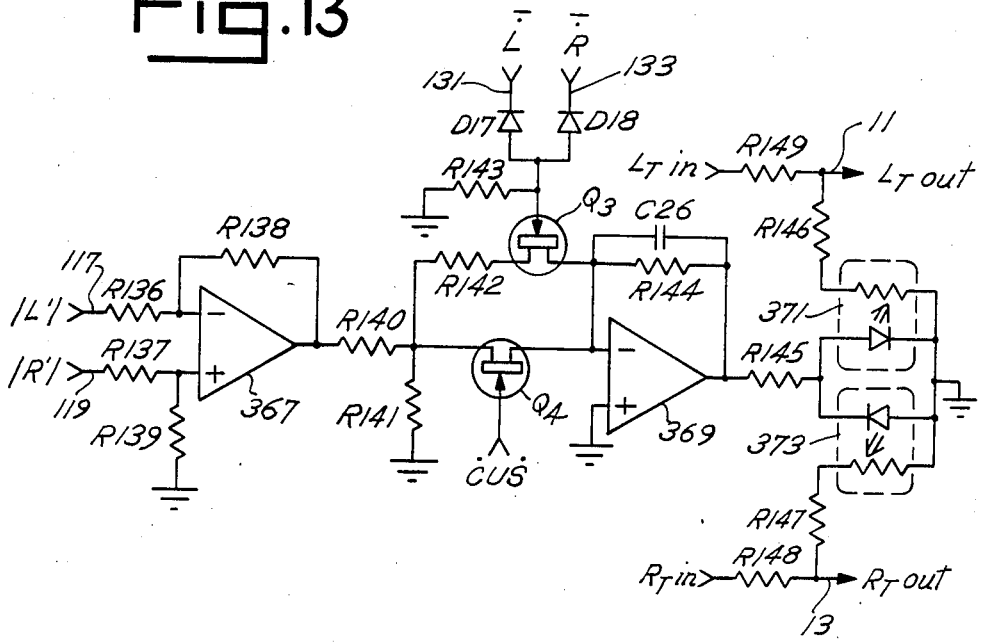
FIG. 13 is a schematic diagram of an automatic balance circuitry using the logic signals developed by the circuitry of FIG. 3.

FIG. 13 uses the logic signals to aid in automatic balance of the incoming signals Lt and Rt. Op amps 367 and 369 are FET input types TL072 or equivalent. $Q_3$ and $Q_4$ are general purpose P-channel JFET's with $V_P<7$ volts. Diodes D17 and D18 are 1N4148 or equivalent. Optocouplers 371 and 373 are VACTEC VTL5C2 or equivalent. |L'| and |R'| are differenced by resistors R136–R139 and op amp 367. The output of 367 is 0 volts if Lt and Rt have the same level, but varies + or − as their relative levels vary. The output of op amp 367 is integrated by C26 in conjunction with op amp 369 and bleed off resistor R144. The input current to the integrator 368 is determined by resistor R140, R141, and R142 and the switching state of FET switches $Q_3$ and $Q_4$. When no directions are being sensed, the output of op amp 369 changes at a moderate rate. If a sound is sensed within the broad C or S region, then it is more likely to be intended to be equal level in Lt and Rt and $Q_4$ switches on to increase the rate of change at the output of 369. If L or R are sensed, then $Q_3$ opens up to stop integration. The gain of the differencing stage is high so that it clips much of the time to make the rate of integration less dependent on overall signal level. The output of op amp 369 drives two oppositely connected optocoupler LED's belonging to optocouplers 371 and 373 through resistor R145. One or the other optocoupler LED may be on at a time causing its associated photoresistor to lower its resistance and pad down either Lt or Rt through attenuation limiting resistor R146 or R147. This will act to balance the average levels of Lt and Rt at a rate dependent on sensed directionality.

The following circuit values are given:

| Resistors | Resistance |
|---|---|
| R7, R9 | 100 |
| R5, R6 | 510 |
| R2, R47 | 1K |
| R37, R40, R42, R45 | 1.5K |
| R48, R50 | 1.8K |
| R49, R51 | 2.2K |
| R1, R135 | 2.7K |
| R39, R41, R44 | 3.0K |
| R13, R16, R19, R22 | 4.3K |
| R26, R30, R70, R73, R74, R78, R82 | 4.7K |
| R69, R77, R81 | 5.1K |
| R11, R14, R17, R20, R145 | 10K |
| R106, R107, R110, R111, R114, R115, R118, R119 | 12K |
| R97 | 15K |
| R23, R24, R27, R28, R105, R109, R113, R117, R136, R137 | 20K |
| R53 | 22K |
| R146, R147 | 24K |

-continued

| | |
|---|---|
| R8, R10, R31, R32, R33, R34, R35, R36, R84, R85, R86, R87, R88, R89, R90, R91, R96, R98, R99 | 30K |
| R72 | 33K |
| R68, R76, R80 | 39K |
| R3, R4, R120, R121, R122, R123, R124, R125, R126, R127, R148, R149 | 51K |
| R104, R108, R112, R116, R128, R129, R130, R131 | 62K |
| R38, R43, R46, R52, R54, R55, R92, R93, R94, R95, R132, R133, R134, R143 | 100K |
| R71, R75, R79, R83 | 270K |
| R56, R57, R58, R59, R138, R139 | 1.0 meg |
| R60, R61, R62, R63, R150, R151, R152, R153 | 2.7 meg |
| R12, R15, R18, R21, R25, R29 | 3.0 meg |
| R141 | 5.6 meg |
| R140, R142 | 44 meg |
| R144 | 2 Gohm |
| R64, R65, R66, R67 | 100K trimpot |
| R100, R101, R102, R103 | 50K trimpot |

| Capacitors | Capacitance |
|---|---|
| C7, C8, C9, C10, C11, C12, C17, C18, C19, C20 | .01 uf |
| C2 | .1 uf |
| C1, C3, C4 | .22 uf |
| C21, C22, C23, C24 | .47 uf |
| C5, C6, C26 | .68 uf |
| C13, C15, C16 | 1.0 uf |
| C14 | 2.2 uf |
| C25 | .056 uf |

What is claimed is:

1. A system for receiving N number of audio input signals encoded with sound information including a plurality of directional sounds, and for driving at least N+1 loudspeakers, the loudspeakers being physically arranged to generate apparent sound images in relation to the encoded directional sounds, comprising:

input means for receiving said encoded input signals;

means for analyzing said encoded input signals for determining whether at least one of said plurality of directional sounds encoded by said input signals exceeds one of a plurality of directional predominance thresholds, said analyzing means generating a plurality of logic control signals, each said logic control signal representing a directional sound and having a logic state representing directional predominance exceeding a corresponding one of said plurality of directional predominance thresholds;

speaker drive means for generating loudspeaker signals from said input signals, said speaker drive means being responsive to said logic signals for dynamically enhancing the directional stability of the apparent sound images generated by the loudspeakers.

2. A system according to claim 1 wherein said analyzing means includes decoding means for decoding said input signals into a plurality of decoded signals carrying sound direction information.

3. A system according to claim 2 wherein each of said decoded signals has a decoding direction, said decoding direction corresponding to an encoded directional sound appearing with maximum gain in the decoded signal.

4. A system according to claim 2 wherein said analyzing means compares the ratios of the levels of said decoded signals.

5. A system according to claim 4 wherein a level of a said decoded signal having a first decoding direction is compared to a level of another said decoded signal having a second decoding direction, said first and second decoding directions corresponding to orthogonally encoded sound directions.

6. A system according to claim 4 wherein the logic state of each of said plurality of logic signals is generated in response to the ratios of levels of said decoded signals exceeding preset threshholds.

7. A system according to claim 6 wherein a plurality of said logic signals may be activated simultaneously by a single directional sound encoded in said input signals.

8. A system according to claim 7 wherein no more than two said logic signals may be generated simultaneously.

9. A system according to claim 1 wherein said speaker drive means includes means for decoding said input signals into a plurality of decoded signals carrying sound direction information, and a modification means responsive to said logic control signals for modifying said decoded signals for enhancing the directional stability of the apparent sound images generated by the loudspeaker sound produced by said loudspeaker signals.

10. A system according to claim 1 wherein said speaker drive means includes means for prolonging the effect of determining that a directional sound exceeds a directional predominance threshhold.

11. A system according to claim 9 wherein said modification means includes voltage producing means for generating a plurality of voltage signals of amplitude determined by the logic states of said logic signals; and gain control means for enhancing the directional stability of apparent sound images generated by the loudspeaker sound produced by said loudspeaker signals responsive to said voltage signals.

12. A system according to claim 11 wherein said voltage producing means produces said voltage signals in accordance with discrete steps in amplitude depending on the logic states of said logic signals.

13. A system according to claim 12 wherein said voltage producing means includes means for smoothing the rapidly changing voltage signals.

14. A system according to claim 13 wherein said smoothing means includes means for limiting the first derivative of the rate of change of said rapidly changing voltage signals.

15. A system according to claim 9 wherein said modification means includes a plurality of mixers, each mixer being associated with a separate one of said loudspeaker signals.

16. A system according to claim 15 wherein said mixer receives a plurality of said decoded signals at relative gains dependent on the logic states of said logic signals.

17. A system according to claim 10 wherein said means for prolonging the effect of determining that a directional sound exceeds a directional predominance threshhold is responsive to the later determining that a second directional sound exceeds a directional predominance threshhold.

18. A system according to claim 17 wherein the degree of response to the determining that said second directional sound exceeds a directional predominance threshhold is dependent on the degree of orthogonality of the encoded sound corresponding to the first named directional sound and said second directional sound.

19. A system according to claim 1 wherein each of said plurality of predominance thresholds is a level substantially constant for all encoded directional sounds.

20. A system according to claim 1 wherein each of said plurality of predominance thresholds is a level substantially constant for all encoded directional sounds, except one.

* * * * *